US011448455B2

(12) United States Patent
Lim et al.

(10) Patent No.: US 11,448,455 B2
(45) Date of Patent: Sep. 20, 2022

(54) REFRIGERATOR

(71) Applicant: SAMSUNG ELECTRONICS CO., LTD., Suwon-si (KR)

(72) Inventors: Changhak Lim, Suwon-si (KR); Jaesung Kwon, Suwon-si (KR); Chulhee Kim, Suwon-si (KR); Sung-Jun Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 259 days.

(21) Appl. No.: 16/829,549

(22) Filed: Mar. 25, 2020

(65) Prior Publication Data

US 2020/0309426 A1 Oct. 1, 2020

(30) Foreign Application Priority Data

Mar. 25, 2019 (KR) ..... 10-2019-0033532

(51) Int. Cl.
*F25D 23/06* (2006.01)
*F25B 39/02* (2006.01)
(Continued)

(52) U.S. Cl.
CPC ..... *F25D 23/061* (2013.01); *F25B 39/024* (2013.01); *F25B 41/37* (2021.01);
(Continued)

(58) Field of Classification Search
CPC ..... F25D 23/061; F25D 23/006; F25B 39/024
See application file for complete search history.

(56) References Cited

U.S. PATENT DOCUMENTS 2,552,345 A 5/1951 Philipp
2,559,367 A * 7/1951 Merrison ..... F25D 23/061 62/442
(Continued)

FOREIGN PATENT DOCUMENTS

CN 108444190 8/2018
JP 10-311621 11/1998
(Continued)

OTHER PUBLICATIONS

Extended European Search Report dated Aug. 5, 2020 in European Patent Application No. 20164882.1.

*Primary Examiner* — Christopher R Zerphey
(74) *Attorney, Agent, or Firm* — Staas & Halsey LLP

(57) ABSTRACT

A refrigerator having an improved structure that enhances the cooling efficiency. The refrigerator includes a main body, a storage compartment formed inside the main body, and a cold air supplier to supply cold air to the storage compartment, the cold air supplier including a compressor compressing a refrigerant, a condenser condensing the compressed refrigerant, a decompressor expanding the condensed refrigerant, an evaporator disposed at a rear of the storage compartment to evaporate the expanded refrigerant, and a refrigerant moving tube connecting the evaporator to the compressor through which the evaporated refrigerant is moved to the compressor so that the refrigerant is recirculated, wherein the evaporator includes a case, a refrigerant tube disposed inside the case such that the refrigerant introduced into the evaporator flows therethrough, and connected to the refrigerant moving tube at an inside of the case, and a heat insulating material filling the inside of the case to cover where the refrigerant tube and the refrigerant moving tube are connected to each other.

13 Claims, 7 Drawing Sheets

(51) Int. Cl.
*F25B 41/37* (2021.01)
*F25D 23/00* (2006.01)

(52) U.S. Cl.
CPC ..... *F25D 23/006* (2013.01); *F25B 2400/052* (2013.01); *F25D 2201/10* (2013.01); *F25D 2317/068* (2013.01)

(56) References Cited

U.S. PATENT DOCUMENTS 4,459,826 A * 7/1984 Hirano ..... F25D 11/022 62/426
5,154,792 A * 10/1992 Patterson ..... C08G 18/0885 252/75
5,544,495 A * 8/1996 Anderson ..... F25D 23/061 62/298
5,727,859 A * 3/1998 Jeong ..... F25D 23/006 312/407.1
5,819,552 A * 10/1998 Lee ..... F25D 17/065 62/407
6,536,227 B1 * 3/2003 Lee ..... F25B 39/02 29/890.038
7,040,118 B2 * 5/2006 Jung ..... F25D 21/04 62/298
7,231,782 B2 * 6/2007 Jung ..... F25D 23/006 62/298
11,047,616 B2 * 6/2021 Jeong ..... F25D 23/067
2007/0289321 A1 * 12/2007 Kang ..... F25D 21/04 62/186
2009/0266105 A1 * 10/2009 Viklund ..... F28F 1/22 29/890.038
2018/0120017 A1 * 5/2018 Wilson ..... F25D 23/006
2018/0142932 A1 5/2018 Knatt et al.
2021/0131706 A1 * 5/2021 Yamada ..... F24F 11/49

FOREIGN PATENT DOCUMENTS

JP 11-142046 5/1999
KR 10-2013-0045722 5/2013

* cited by examiner

REFRIGERATOR

CROSS-REFERENCE TO RELATED APPLICATION(S)

This application is based on and claims priority under 35 U.S.C. § 119 to Korean Patent Application No. 10-2019-0033532, filed on Mar. 25, 2019 in the Korean Intellectual Property Office, the disclosure of which is incorporated by reference herein in its entirety.

BACKGROUND

1. Field

The disclosure relates to a refrigerator, and more specifically, to a refrigerator having an improved structure that enhances the cooling efficiency.

2. Description of the Related Art

A refrigerator is a home appliance that is equipped with a main body having a storage compartment, a cold air supply device provided to supply cold air to the storage compartment, and a door provided to open or close the storage compartment and stores foods in a fresh state.

The cold air supply device includes a compressor for compressing a refrigerant, a condenser for condensing the refrigerant compressed by the compressor, a decompression device, such as a capillary tube or an expansion valve configured to decompress the refrigerant condensed in the condenser, and an evaporator for evaporating the refrigerant decompressed by the decompression device to absorb latent heat of vaporization from air circulating in the storage compartment to cool the storage compartment, and a refrigerant circulation tube for connecting the compressor, the condenser, the decompression device, and the evaporator to form a passage through which the refrigerant flows.

The refrigerant circulation tube may include a refrigerant moving tube for connecting the evaporator to the compressor such that the refrigerant evaporated in the evaporator is moved to the compressor.

In general, one end of the refrigerant moving tube may be connected to the evaporator by welding. When welding is not performed properly in a process of connecting the one end of the refrigerant moving tube to the evaporator, the refrigerant may leak. Refrigerant leakage may lead to a decrease in the cooling efficiency of the refrigerator.

SUMMARY

Therefore, it is an object of the disclosure to provide a refrigerator having an improved structure of integrally forming a refrigerant moving tube with an evaporator.

Therefore, it is another object of the disclosure to provide a refrigerator having an improved structure that prevents cold air from leaking.

Additional aspects of the disclosure will be set forth in part in the description which follows and, in part, will be obvious from the description, or may be learned by practice of the disclosure.

Therefore, it is an aspect of the disclosure to provide a refrigerator including: a main body; a storage compartment formed inside the main body; and a cold air supplier provided to supply cold air to the storage compartment, and including a compressor compressing a refrigerant, a condenser condensing the compressed refrigerant, a decompressor expanding the condensed refrigerant, an evaporator disposed at a rear of the storage compartment to evaporate the expanded refrigerant, and a refrigerant moving tube connecting the evaporator to the compressor through which the evaporated refrigerant is moved to the compressor so that the refrigerant is recirculated, wherein the evaporator includes: a case; a refrigerant tube disposed inside the case such that the refrigerant introduced into the evaporator flows therethrough, and connected to the refrigerant moving tube at an inside of the case; and a heat insulating material filling the inside of the case to cover where the refrigerant tube and the refrigerant moving tube are connected to each other.

The case of the evaporator may be coupled to a rear wall of the storage compartment.

The refrigerator may further include a plate forming one side of the case that faces the storage compartment, and the refrigerant tube and the refrigerant moving tube are coupled to each other on the plate.

The plate may made of a metal material.

The case may include: a frame having an opening formed in a middle thereof; the opening including a first open side that is open toward the main body, and a second open side that is open toward the storage compartment and is coupled with the plate to be covered by the plate.

A rear wall of the storage compartment may be formed with a coupling protrusion that protrudes from the rear wall of the storage compartment in a direction toward an outer side of the storage compartment, and the side wall frame may include: a first end part defining a circumference of the first open side; a second end part defining a circumference of the second open side; and an extension part extending from the second end part in a direction toward an outer side of the case, the extension part having a coupling groove to which the coupling protrusion is coupled.

The refrigerator may further include: a cold air passage configured for cold air supplied from the cold air supplier to circulate in the storage compartment; and a partition plate installed inside the storage compartment to form the cold air passage.

The partition plate may include a first partition part facing the rear wall of the storage compartment and a second partition part bent from the first partition part and extended while facing an upper wall of the storage compartment.

The rear wall of the storage compartment may be formed with an opening that allows the plate to be exposed to an inside of the storage compartment, and the cold air passage may include a first section having a part formed between the first partition part and the plate and a remaining part formed between the first partition part and the rear wall of the storage compartment, and the first section may include a cold air inlet.

The cold air passage may further include a second section formed between the second partition part and the upper wall of the storage compartment and including a cold air outlet.

The cold air supplier may further include a fan installed in the second section of the cold air passage.

The refrigerator may further include a machine room disposed at a lower side of the storage compartment and in which the compressor is disposed, wherein one end part of the refrigerant moving tube connected to the compressor may be exposed to an outside of the evaporator by passing through the case.

The decompressor may include a capillary tube connecting the evaporator to the condenser.

The capillary tube may be connected to the refrigerant tube at an inside of the case, and the heat insulating material may fill the inside of the case to cover a connection part between the capillary tube and the refrigerant tube.

One end part of the capillary tube connected to the condenser may be exposed to an outside of the evaporator by passing through the case.

It is another aspect of the disclosure to provide a refrigerator including: a main body including an inner case and an outer case disposed at an outer side of the inner case to form an external appearance of the refrigerator; a storage compartment formed in the inner case and having a front side that is open; a door configured to open or close the open front side of the storage compartment; an evaporator disposed between a rear wall of the storage compartment and the outer case to generate cold air through heat exchange with a refrigerant introduced to the evaporator, wherein the evaporator includes: a case having a coupling groove to which a coupling protrusion protruded from the rear wall of the storage compartment is coupled; a refrigerant tube disposed inside the case such that a refrigerant flows therethrough; and a heat insulating material filling the inside of the case to cover the refrigerant tube disposed in the case.

The rear wall of the storage compartment may be formed with a rear wall opening, the evaporator may further include a plate forming one side of the case that faces the rear wall of the storage compartment and exposed to an inside of the storage compartment through the rear wall opening.

The plate may is made of metal material, and the refrigerant tube may be disposed on the plate to come into contact with the plate.

The refrigerator may further include: a compressor configured to compress the refrigerant passing through the evaporator; and a refrigerant moving tube connecting the evaporator to the compressor, the refrigerant moving tube including a first part located inside the case to be connected to the evaporator and a second part located outside the case to be connected to the compressor, wherein the heat insulating material may fill the inside of the case to cover the first part of the refrigerant moving tube located inside the case.

The refrigerator may further include: a capillary tube connected to the evaporator to supply an expanded refrigerant to the evaporator, wherein a part of the capillary tube may be located inside the case to be connected to the refrigerant tube of the evaporator and the part, together with the refrigerant tube, may be covered by the heat insulating material.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the disclosure will be described in detail with reference to the accompanying drawings. On the other hand, the terms "front end", "rear end", "upper part", "lower part", "upper end" and "lower end" used in the following description are defined based on the drawings, and the shape and position of each component is not limited by these terms.

In the following description, "X" refers to a front side and rear side direction of a refrigerator 1, "Y" refers to a left side and right side direction of the refrigerator 1, and "Z" refers to an upper side and low side direction of the refrigerator 1.

Figure 1:
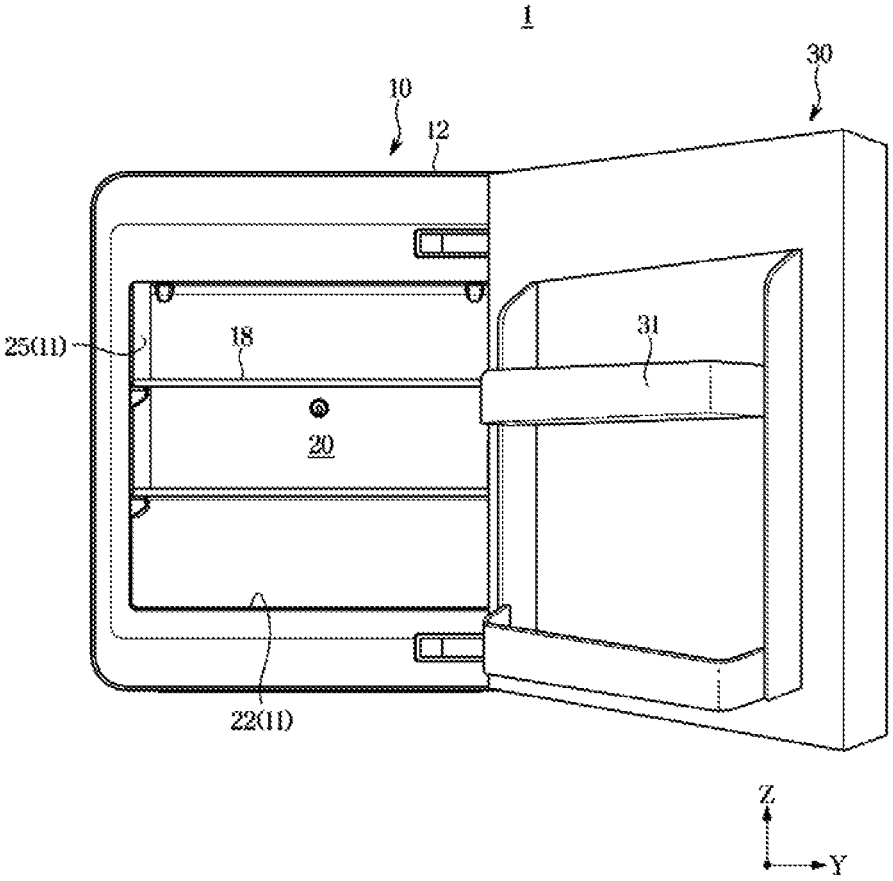
FIG. 1 is a perspective view illustrating a refrigerator according to an embodiment of the disclosure.
Figure 2:
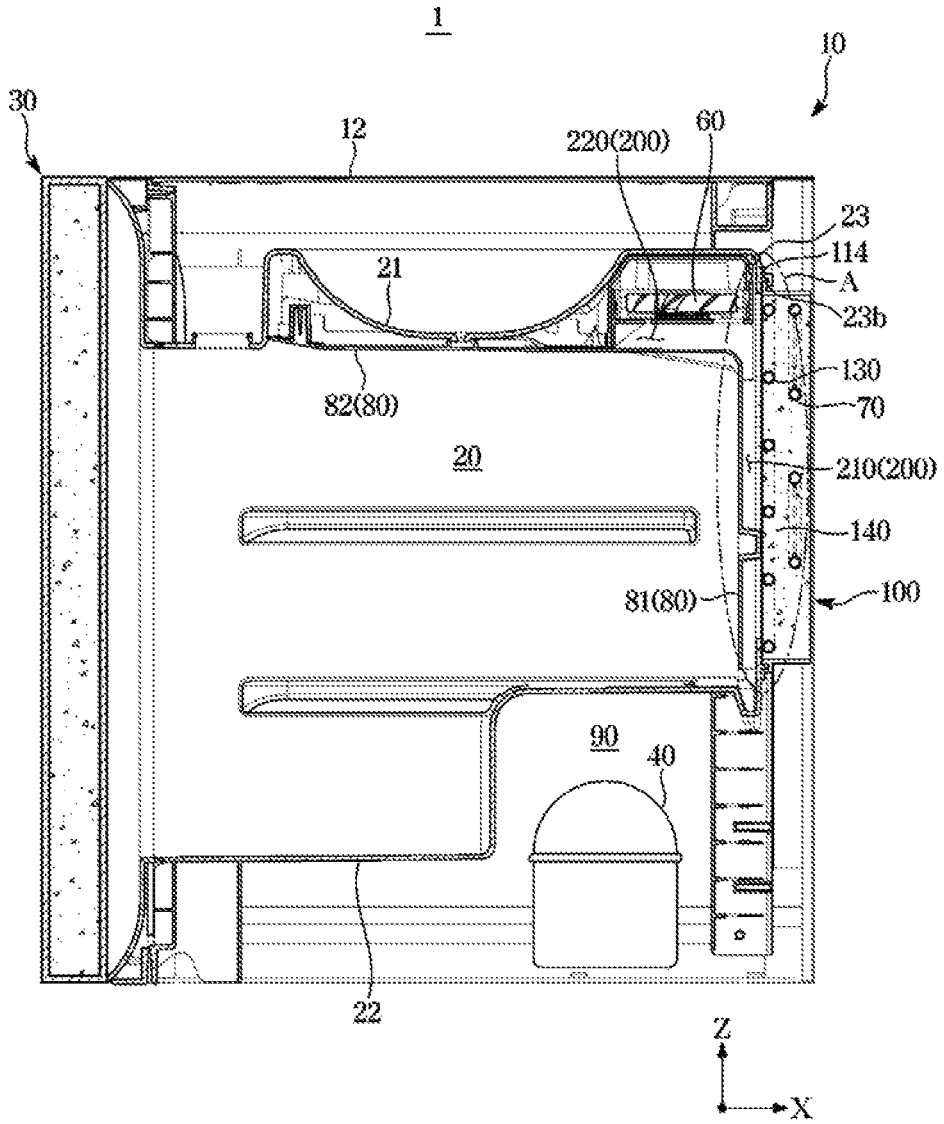
FIG. 2 is a cross-sectional view illustrating a refrigerator according to an embodiment of the disclosure.

FIG. 1 is a perspective view illustrating a refrigerator according to an embodiment of the disclosure, and FIG. 2 is a cross-sectional view illustrating a refrigerator according to an embodiment of the disclosure.

Referring to FIGS. 1 and 2, the refrigerator 1 may include a main body 10 and a storage compartment 20 provided inside the main body 10.

The main body 10 may include an inner case 11 forming the storage compartment 20 and an outer case 12 disposed at an outer side of the inner case 11 to form the external appearance of the refrigerator 1. A heat insulating material (not shown) may be foamed between the inner case 11 and the outer case 12 of the main body 10 to prevent cold air from leaking out of the storage compartment 20.

The storage compartment 20 may be defined or formed by the inner case 11. The storage compartment 20 may have an open front side. The storage compartment 20 includes an upper wall 21, a lower wall 22 facing the upper wall 21, a rear wall 23 facing the open front side, a right side wall (not shown) and a left side wall 25 facing the right side wall. In the storage compartment 20, a plurality of shelves 18 may be provided in the storage compartment 20 to partition the storage compartment 20 into a plurality of regions.

The refrigerator 1 may further include a door 30 provided to open or close the storage compartment 20. The door 30 may be provided to open or close the open front side of the storage compartment 20. In detail, the door 30 may be rotatably installed in the main body 10 to open or close the open front side of the storage compartment 20. A plurality of door guards 31 may be provided on a rear surface of the door 30 to accommodate food items.

The refrigerator 1 may further include a cold air supply device provided to supply cold air to the storage compartment 20. The cold air supply device includes a compressor 40 for compressing a refrigerant, a condenser (not shown) for condensing the refrigerant, a decompression device for expanding the refrigerant, an evaporator 100 for evaporating the refrigerant, a fan 60, and a refrigerant circulation tube connecting the compressor 40, the condenser, the decompression device, and the evaporator 100 to form a passage through which the refrigerant flows.

The decompression device may include a capillary tube 50 (see FIG. 3) connecting the evaporator 100 to the condenser. However, the decompression device is not limited thereto and may be provided in a variety of types. As one example, the decompression device may include an expansion valve. The following description will be made in relation that the capillary tube 50 is used as a decompression device.

The refrigerant circulation tube may include a refrigerant moving tube 70 (see FIG. 3) connecting the evaporator 100 to the compressor 40.

The fan 60 may be installed on a cold air passage 200. In detail, the fan 60 may be installed in a second section 220 of the cold air passage 200. In more detail, the fan 60 may be installed in the second section 220 to be adjacent to a first section 210 of the cold air passage 200.

The evaporator 100 may be disposed at a rear side of the storage compartment 20 to evaporate the refrigerant. In other words, the evaporator 100 may be disposed between the rear wall 23 of the storage compartment 20 and the outer case 12 to generate cold air through heat exchange with the refrigerant. Preferably, the evaporator 100 may be manufactured as a module for easy assembly and may be fixedly coupled to the rear wall 23 of the storage compartment 20. Details of the evaporator 100 will be described below.

The refrigerator 1 may further include a machine room 90 provided at a lower side of the storage room 20. In other words, the machine room 90 may be provided at the rear lower side of the main body 10. The compressor 40 and the condenser may be arranged in the machine room 90.

The refrigerator 1 may include the cold air passage 200 provided such that cold air supplied from the cold air supply device circulates in the storage compartment 20, and a partition plate 80 installed in the storage compartment 20 to form the cold air passage 200. The storage compartment 20 may be partitioned into a plurality of spaces including the cold air passage 200 by the partition plate 80.

The partition plate 80 includes a first partition portion 81 facing the rear wall 23 of the storage compartment 20 and a second partition portion 82 bent from the first partition portion 81 and extending while facing the upper wall 21 of the storage compartment 20. The first partition portion 81 may extend in the upper side and lower side direction (Z) of the refrigerator 1. The second partition portion 82 may extend in the front side and rear side direction (X) of the refrigerator 1. The second partition portion 82 may be bent from an upper end of the first partition portion 81 and extended.

The cold air passage 200 includes the first section 210 formed between the first partition portion 81 and the evaporator 100 and the rear wall 23 of the storage compartment 20 that face the first partition portion 81. In detail, the first section 210 may be formed between the first partition portion 81 and each of a plate 120 (see FIG. 4) of the evaporator 100 and the rear wall 23 of the storage compartment 20 facing the first partition portion 81. In more detail, a part of the first section 210 may be formed between the first partition portion 81 and the rear wall 23 of the storage compartment 20 facing the facing the first partition portion 81, and a remaining portion of the first section 210 may be formed between the first partition portion 81 and the plate 120 of the evaporator 100 facing the first partition portion 81. The cold air passage 200 may include a cold air inlet 230 (see FIG. 7). The cold air inlet 230 may be formed at a lower end portion of the first section 210. In other words, the cold air inlet 230 may be formed between the lower end portion of the first partition portion 81 and the rear wall 23 of the storage compartment 20 facing the lower end portion of the first partition portion 81.

The cold air passage 200 may further include the second section 220 formed between the second partition portion 82 and the upper wall 21 of the storage compartment 20 facing the second partition portion 82. In detail, the second section 220 of the cold air passage 200 may be defined by the second partition portion 82, the upper wall 21 of the storage compartment 20 facing the second partition portion 82, a part of the rear wall 23 of the storage compartment 20 bent from the upper wall 21 of the storage compartment 20 and extending in a direction toward the lower side of the refrigerator 1, and the plate 120 of the evaporator 100. The cold air passage 200 may include a cold air outlet 240 (see FIG. 7). The cold air outlet 240 may be formed in the second section 220. Cold air introduced into the cold air passage 200 through the cold air inlet 230 is heat exchanged with the refrigerant of the evaporator 100 and then is discharged to the storage compartment through the cold air outlet 240. The cold air outlet 240 may be formed between the second partition portion 82 and the upper wall 21 of the storage compartment 20. In other words, the cold air outlet 240 may be formed in the gap between the second partition portion 82 and the upper wall 21 of the storage compartment 20. Alternatively, the cold air outlet 240 may be formed in the second partition portion 82. In this case, the cold air outlet 240 may be formed to pass through the second partition portion 82 in the form of a plurality of holes.

The positions of the cold air inlet 230 and the cold air outlet 240 are not limited thereto as long as the cold air passage 200 can communicates with the storage compartment 20.

Figure 3:
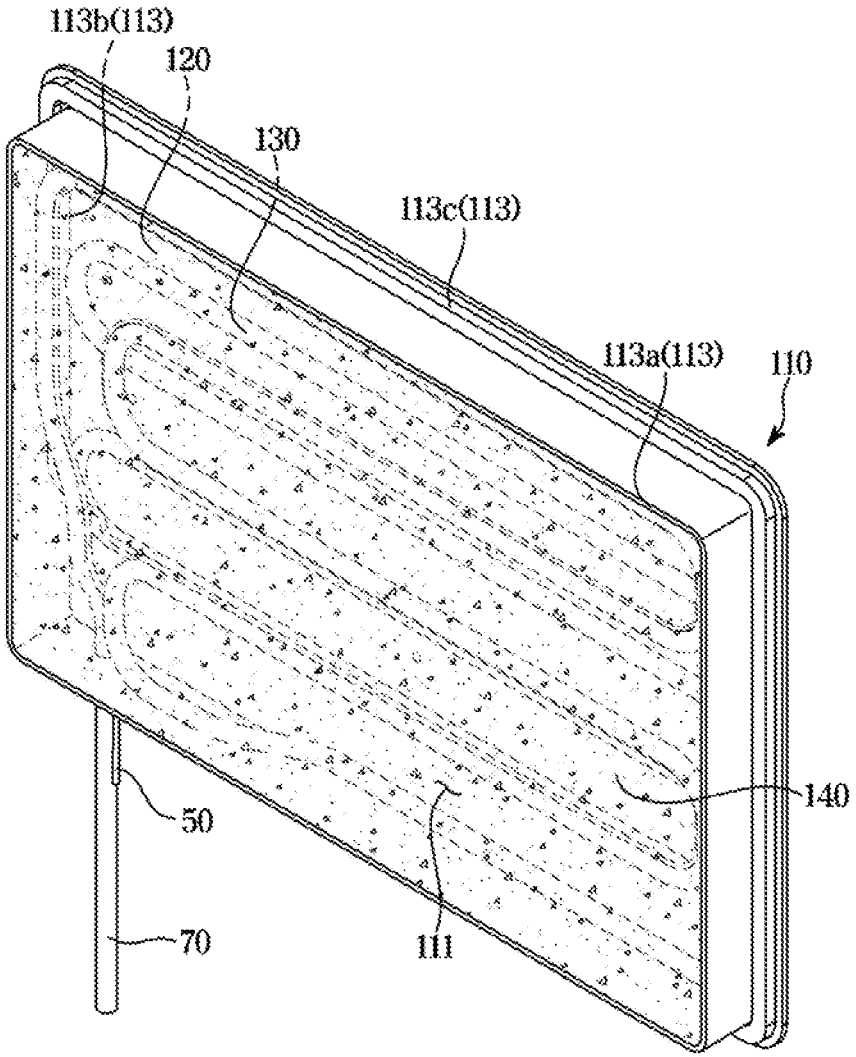
FIG. 3 is a perspective view illustrating an evaporator in a refrigerator according to one embodiment of the disclosure.
Figure 4:
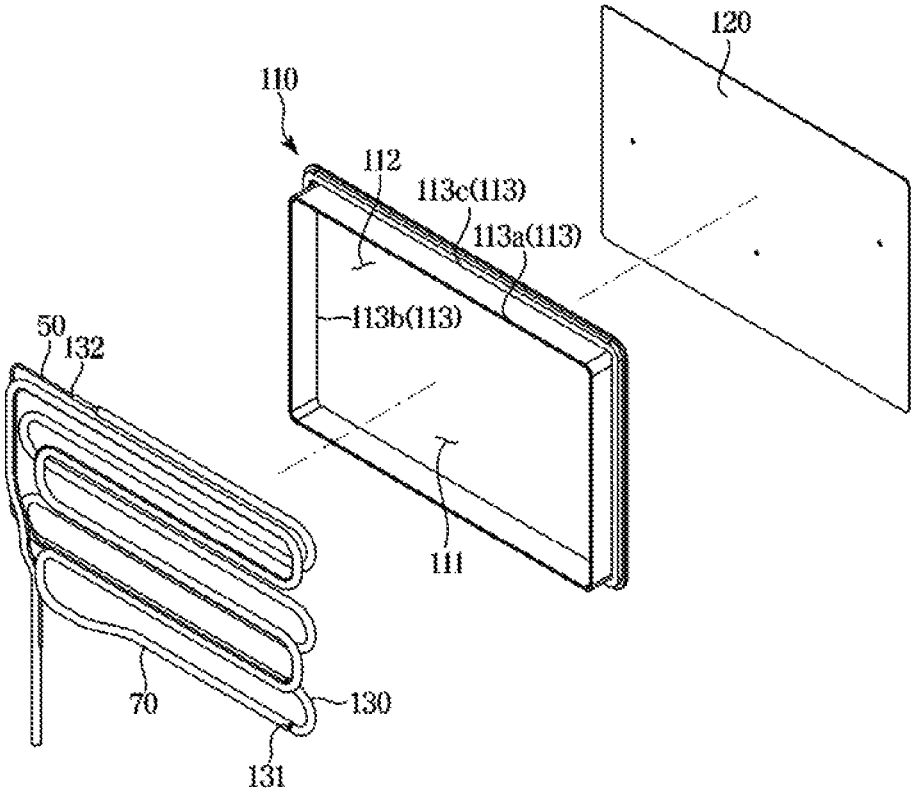
FIG. 4 is an exploded perspective view illustrating an evaporator in a refrigerator according to an embodiment of the disclosure.
Figure 5:
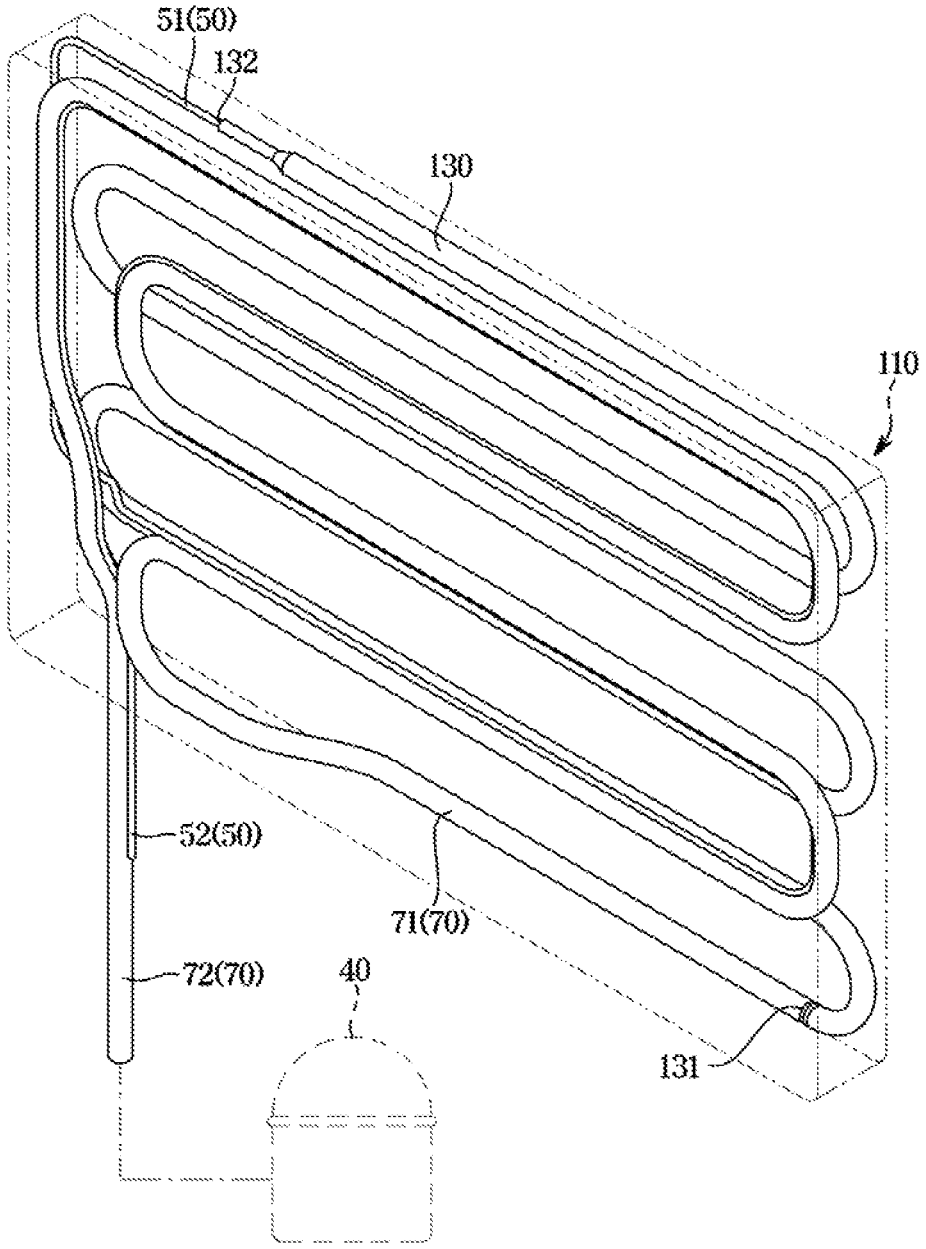
FIG. 5 is an enlarged view illustrating a partial configuration of FIG. 4.
Figure 6:
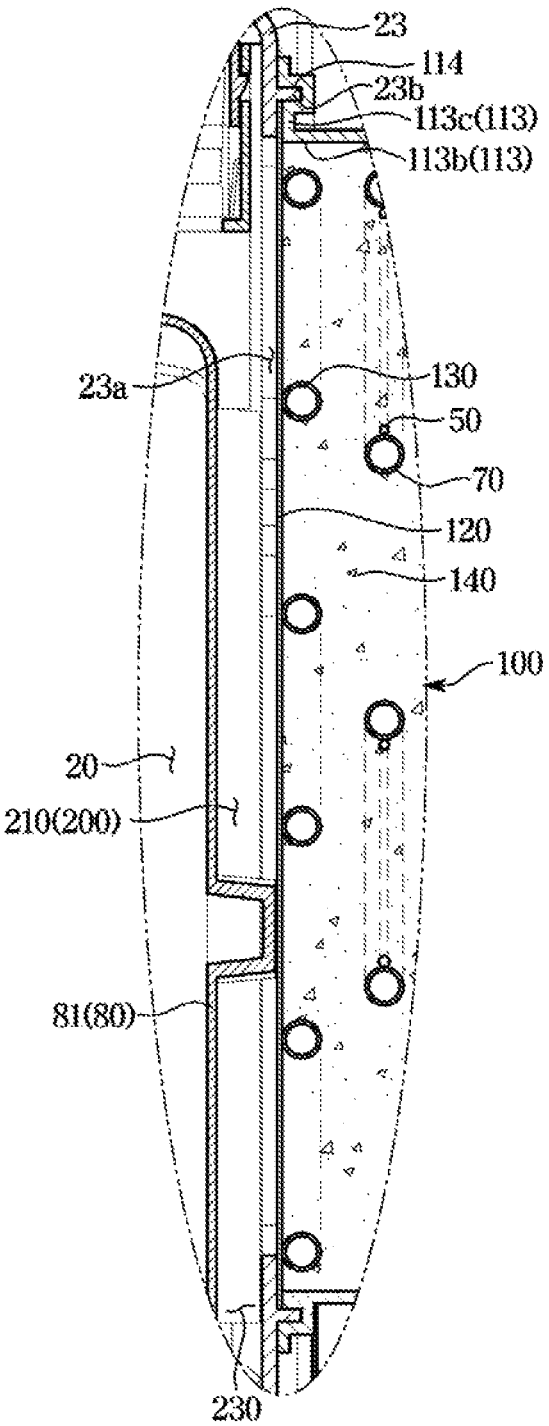
FIG. 6 is an enlarged view of part A of FIG. 2.

FIG. 3 is a perspective view illustrating an evaporator in a refrigerator according to one embodiment of the disclosure, FIG. 4 is an exploded perspective view illustrating an evaporator in a refrigerator according to an embodiment of the disclosure, FIG. 5 is an enlarged view illustrating a partial configuration of FIG. 4, and FIG. 6 is an enlarged view of part A of FIG. 2.

Referring to FIGS. 3 to 6, the evaporator 100 may be provided in the form of a module.

The evaporator 100 may include a case 110. The case 110 may be formed as an injection molded product. As an example, the case 110 may have a box shape including two open sides facing each other. In detail, the case 110 may include a first open side 111 that is open toward the main body 10, a second open side 112 that is open toward the storage compartment 20 while facing the first open side 111, and a sidewall frame 113 formed along the circumference of the first open side 111 and the second open side 112. The second open side 112 of the case 110 may be open toward the rear wall 23 of the storage compartment 20. The plate 120 may be coupled to the second open side 112 of the case 110. The plate 120 may be coupled to the case 110 to cover the second open side 112 of the case 110 while forming the external appearance of the evaporator 100 together with the case 110.

The rear wall 23 of the storage compartment 20 is formed with a coupling protrusion 23*b* (see FIG. 2) protruding from the rear wall 23 of the storage compartment 20 in a direction toward an outer side of the storage compartment 20. The side wall frame 113 of the case 110 includes a first end portion 113*a* defining the circumference of the first open side 111, a second end portion 113*b* defining the circumference of the second open side 112, and an extension portion 113*c* extending from the second end portion 113*b* in a direction toward an outer side of the case 110. The extension portion 113*c* may have a coupling groove 114 (see FIG. 2) to which the coupling protrusion 23*b* formed on the rear wall 23 of the storage compartment 20 is coupled.

The evaporator 100 may further include the plate 120. The plate 120 may be formed of a metal material to improve the heat exchange efficiency. The plate 120 may form one surface of the case 110 facing the storage compartment 20. In other words, the plate 120 may be coupled to the second open side 112 of the case 110 to form one surface of the case 110 facing the storage compartment 20. The rear wall 23 of the storage compartment 20 may be formed with an opening 23*a*. The plate 120 of the evaporator 100 may be exposed to the inside of the storage compartment 20 through the opening 23*a* of the rear wall 23 of the storage compartment 20. In other words, the plate 120 of the evaporator 100 is exposed to the inside of the storage compartment 20 through the opening 23*a* of the rear wall 23 of the storage compartment 20, so as to form the cold air passage 200 together with the first partition portion 81 of the partition plate 80. The cold air moving along the cold air passage 200 may come into direct contact with the plate 120 of the evaporator 100.

The evaporator 100 may further include a refrigerant tube 130 disposed inside the case 110 such that the refrigerant introduced into the evaporator 100 flows in the refrigerant tube 130. The refrigerant tube 130 may have a plurality of bent portions. Similar to the plate 120, the refrigerant tube 130 may be formed of a metal material to improve the heat exchange efficiency. The refrigerant tube 130 may be disposed on the plate 120 to be positioned inside the case 110. The refrigerant tube 130 may be disposed on the plate 120 to come into direct contact with the plate 120. The refrigerant tube 130 may be coupled to the plate 120. As an example, the refrigerant tube 130 may be coupled to the plate 120 by a tape, a thermoplastic adhesive, or the like. However, the method of coupling the refrigerant tube 130 to the plate 120 is not limited to the above examples, and may be variously provided. As such, when the refrigerant tube 130 of the evaporator 100 is disposed on the plate 120 having a metal material, the air moving along the cold air passage 200 may be subject to heat exchange with the refrigerant moving along the refrigerant tube 130 of the evaporator 100 with a high efficiency.

The refrigerant tube 130 may be connected to the refrigerant moving tube 70. In detail, the refrigerant tube 130 may be connected to the refrigerant moving tube 70 at an inside of the case 110. The refrigerant moving tube 70 may be bent to have a plurality of bent portions. The refrigerant tube 130 may be connected to the refrigerant moving tube 70 by welding. In addition, the refrigerant tube 130 may be integrally formed with the refrigerant moving tube 70 and processed to be bent.

The refrigerant moving tube 70 may be disposed on the plate 120 with a part thereof positioned inside the case 110. The refrigerant moving tube 70 may be disposed on the plate 120 to come into direct contact with the plate 120. The refrigerant moving tube 70 may be coupled to the plate 120. As an example, the refrigerant moving tube 70 may be coupled to the plate 120 by a tape, a thermoplastic adhesive, or the like. However, the method of coupling the refrigerant moving tube 70 to the plate 120 is not limited to the above examples, and may be variously changed.

The evaporator 100 may further include a heat insulating material 140 provided to fill the inside of the case 110. The heat insulating material 140 may fill the inside of the case 110 to cover a connection portion 131 between the refrigerant tube 130 and the refrigerant moving tube 70. In other words, the heat insulating material 140 may fill the inside of the case 110 to cover the refrigerant tube 130 disposed inside the case 110. In addition, the heat insulating material 140 may fill the inside of the case 110 to cover a connection portion 132 between the capillary tube 50 and the refrigerant tube 130. The connection portion 132 between the capillary tube 50 and the refrigerant tube 130 may be positioned above the connection portion 131 between the refrigerant moving tube 70 and the refrigerant tube 130. As an example, the heat insulating material 140 may include urethane, expanded polystyrene (EPS), and the like. In general, the refrigerant tube 130 and the refrigerant moving tube 70 may be connected to each other by welding. When welding is not performed properly in the process of connecting the refrigerant tube 130 to the refrigerant moving tube 70, the refrigerant may leak and the cooling efficiency of the refrigerator 1 may decrease. Accordingly, when the refrigerant tube 130 and the refrigerant moving tube 70 are connected by welding, the case 110 is filled with the heat insulating material 140 to cover the connection portion 131 between the refrigerant tube 130 and the refrigerant moving tube 70 positioned inside the case 110, so that the refrigerant may be effectively prevented from leaking through the connection portion 131 even when welding is not performed properly.

The case 110 of the evaporator 100 may be coupled to the rear wall 23 of the storage compartment 20. In detail, the evaporator 100 may be coupled to the rear wall 23 of the storage compartment 20 by the coupling between the coupling protrusion 23*b* formed on the rear wall 23 of the storage compartment 20 and the coupling groove 114 formed in the case 110. The coupling protrusion 23*b* may be fitted into the coupling groove 114. As such, by coupling the case 110 of the evaporator 100 to the rear wall 23 of the storage compartment 20 through the coupling between the coupling protrusion 23*b* and the coupling groove 114, the leakage of cold air may effectively prevented in the process of coupling the case 110 of the evaporator 100 to the rear wall 23 of the storage compartment 20. That is, the coupling protrusion 23*b* formed on the rear wall 23 of the storage compartment 20 and the coupling groove 114 formed in the case 110 of the evaporator 100 are coupled to each other to form a sealing structure capable of preventing cold air from leaking.

The refrigerant moving tube 70 may connect the evaporator 100 to the compressor 40. In detail, the refrigerant moving tube 70 may connect the refrigerant tube 130 to the compressor 40 of the evaporator 100. One end of the refrigerant moving tube 70 connected to the compressor 40 may be exposed to the outside of the evaporator 100 by passing through the case 110. In detail, the one end of the refrigerant moving tube 70 connected to the compressor 40 may be exposed to the outside of the evaporator 100 by passing through the side wall frame 113 of the case 110.

The refrigerant moving tube 70 may include a first part 71 positioned inside the case 110 so as to be connected to the evaporator 100. The first part 71 of the refrigerant moving tube 70 may be located inside the case 110 so as to be connected to the refrigerant tube 130 of the evaporator 100. The refrigerant movement tube 70 may further include a second part 72 positioned outside the case 110 so as to be connected to the compressor 40. The heat insulating material 140 may fill the inside of the case 110 to cover the first part 71 of the refrigerant moving tube 70 positioned in the case 110. That is, the heat insulating material 140 may fill the inside of the case 110 to cover the refrigerant tube 130 and the first part 71 of the refrigerant moving tube 70.

The capillary tube 50 may be connected to the evaporator 100 to supply the expanded refrigerant to the evaporator 100. In detail, the capillary tube 50 may be connected to the refrigerant tube 130 of the evaporator 100 at the inside of the case 110. That is, one end of the refrigerant tube 130 may be connected to the capillary tube 50, and the other end of the refrigerant tube 130 may be connected to the refrigerant moving tube 70. As an example, the upper end of the refrigerant tube 130 may be connected to the capillary tube 50, and the lower end of the refrigerant tube 130 may be connected to the refrigerant moving tube 70.

The capillary tube 50 may have a diameter smaller than those of the refrigerant tube 130 and the refrigerant moving tube 70. The capillary tube 50 may be bent to have a plurality of bent portions.

One end of the capillary tube 50 connected to the condenser may be exposed to the outside of the evaporator 100 by passing through the case 110. Preferably, the one end of the capillary tube 50 connected to the condenser may be exposed to the outside of the evaporator 100 by passing through the side wall frame 113 of the case 110 together with the one end of the refrigerant moving tube 70 connected to the compressor 40.

The capillary tube 50 may include a first part 51 positioned inside the case 110 to be connected to the evaporator 100. The first part 51 of the capillary tube 50 may be located inside the case 110 so as to be connected to the refrigerant tube 130 of the evaporator 100. The capillary tube 50 may further include a second part 52 positioned outside the case 110 so as to be connected to the condenser. The heat insulating material 140 may fill the inside of the case 110 to cover the first part 51 of the capillary tube 50 positioned inside the case 110. That is, the heat insulating material 140 may fill the inside of the case 110 to cover the refrigerant tube 130, the first part 71 of the refrigerant moving tube 70, and the first art 51 of the capillary tube 50.

Figure 7:
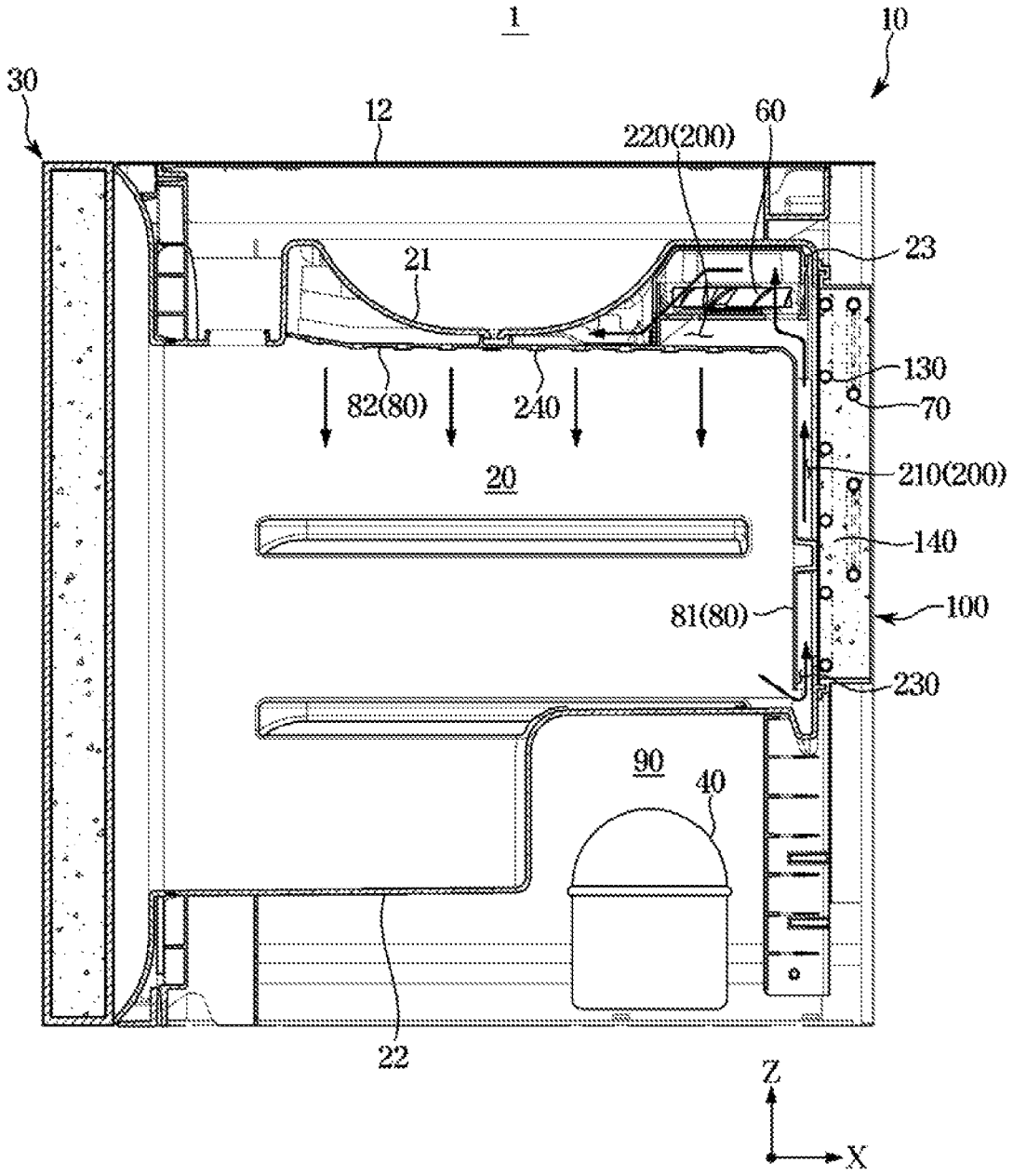
FIG. 7 is a view illustrating the flow of cold air in a refrigerator according to an embodiment of the disclosure.

FIG. 7 is a view illustrating the flow of cold air in a refrigerator according to an embodiment of the disclosure;

Referring to FIG. 7, air inside the storage compartment 20 is introduced into the cold air passage 200 through the cold air inlet 230. The air introduced into the cold air passage 200 is cooled by heat exchange with the refrigerant flowing along the refrigerant tube 130 of the evaporator 100, and sequentially passes through the fan 60 and the cold air outlet 240, after which the air is discharged into the storage compartment 20. The cold air discharged into the storage chamber 20 through the cold air outlet 240 cools the storage chamber 20 while circulating in the storage chamber 20.

As described above, the evaporator 100, the capillary tube 50, and the refrigerant moving tube 70 are integrally formed as a unitary module, to thereby simplifying the process of foaming the thermal insulating material 140 and facilitating the installation of the evaporator 100, the capillary tube 50, and the refrigerant moving tube 70.

As is apparent from above, the refrigerant moving tube and the evaporator are integrally formed as a unitary module, so that cold air is effectively prevented from leaking from the connection portion between the refrigerant moving tube and the refrigerant tube.

Although embodiments of the disclosure have been described with reference to the accompanying drawings, a person having ordinary skilled in the art will appreciate that other specific modifications can be easily made without departing from the technical spirit or essential features of the disclosure.

What is claimed is:

1. A refrigerator comprising:

a main body including an inner case forming a storage compartment and an outer case disposed at an outer side of the inner case; and a cold air supplier to supply cold air to the storage compartment, the cold air supplier including a compressor compressing a refrigerant, a condenser condensing the compressed refrigerant, a decompressor expanding the condensed refrigerant, an evaporator disposed at a rear of the storage compartment to evaporate the expanded refrigerant, and a refrigerant moving tube connecting the evaporator to the compressor through which the evaporated refrigerant is moved to the compressor so that the refrigerant is recirculated, wherein the evaporator includes:

an evaporator case;

an evaporator refrigerant tube disposed inside the evaporator case, the refrigerant moving tube penetrated through the evaporator case and connected to the evaporator refrigerant tube at an inside of the evaporator case;

a plate forming one side of the evaporator case that faces the storage compartment, the evaporator refrigerant tube and the refrigerant moving tube coupled to each other on the plate; and a heat insulating material filled inside the evaporator case to cover a first connected portion between the evaporator refrigerant tube and the refrigerant moving tube to prevent the refrigerant from leaking through the first connected portion, wherein the evaporator case is coupled to a rear wall of the storage compartment by coupling a coupling protrusion formed on the rear wall of the storage compartment to a coupling groove formed in the evaporator case, and wherein the rear wall of the storage compartment is formed with an opening that allows the plate to be exposed to an inside of the storage compartment.

2. The refrigerator of claim 1, wherein the plate is made of a metal material.

3. The refrigerator of claim 1, wherein the evaporator case further includes a frame having an opening formed in a middle thereof, the opening includes a first open side that is open toward the main body, and a second open side that is open toward the storage compartment and is coupled with the plate to be covered by the plate.

4. The refrigerator of claim 3, wherein the coupling protrusion that protrudes from the rear wall in a direction toward an outer side of the storage compartment, wherein the frame includes:

a first end part defining a circumference of the first open side;

a second end part defining a circumference of the second open side; and an extension part extending from the second end part in a direction toward an outer side of the evaporator case, and wherein the coupling groove to which the coupling protrusion is coupled is formed on the extension part.

5. The refrigerator of claim 1, further comprising:

a cold air passage configured for cold air supplied from the cold air supplier to circulate in the storage compartment; and a partition plate installed inside the storage compartment to form the cold air passage.

6. The refrigerator of claim 5, wherein the partition plate includes a first partition part facing the rear wall of the storage compartment and a second partition part bent from the first partition part and extended while facing an upper wall of the storage compartment.

7. The refrigerator of claim 6, wherein the cold air passage includes a first section having a part formed between the first partition part and the plate and a remaining part formed between the first partition part and the rear wall of the storage compartment, and the first section includes a cold air inlet.

8. The refrigerator of claim 7, wherein the cold air passage further includes a second section formed between the second partition part and the upper wall of the storage compartment and including a cold air outlet.

9. The refrigerator of claim 8, wherein the cold air supplier further comprises a fan installed in the second section of the cold air passage.

10. The refrigerator of claim 1, further comprising a machine room disposed at a lower side of the storage compartment and in which the compressor is disposed, wherein one end part of the refrigerant moving tube connected to the compressor is exposed to an outside of the evaporator by passing through the evaporator case.

11. The refrigerator of claim 1, wherein the decompressor includes a capillary tube connecting the evaporator to the condenser.

12. The refrigerator of claim 11, wherein the capillary tube passed through the evaporator case and is connected to the evaporator refrigerant tube at the inside of the evaporator case, and the heat insulating material filled inside the evaporator case to cover a second connected portion between the capillary tube and the evaporator refrigerant tube to prevent the refrigerant from leaking through the second connected portion.

13. The refrigerator of claim 12, wherein one end part of the capillary tube connected to the condenser is exposed to an outside of the evaporator.

* * * * *